US008273243B2

(12) United States Patent
Nicolaos et al.

(10) Patent No.: US 8,273,243 B2
(45) Date of Patent: Sep. 25, 2012

(54) PROCESS FOR DESULFURIZATION AND DENITRATION OF A GAS-OIL-TYPE HYDROCARBON FRACTION THAT CONTAINS NITROGEN COMPOUNDS

(75) Inventors: Alexandre Nicolaos, Courbevoie (FR); Patrick Briot, Pommier de Beaurepaire (FR); Danielle Richard, Lyons (FR)

(73) Assignee: IFP Energies nouvelles, Rueil-Malmaison Cedex (FR)

( * ) Notice: Subject to any disclaimer, the term of this patent is extended or adjusted under 35 U.S.C. 154(b) by 192 days.

(21) Appl. No.: 12/529,518

(22) PCT Filed: Feb. 14, 2008

(86) PCT No.: PCT/FR2008/000206

§ 371 (c)(1), (2), (4) Date: Mar. 30, 2010

(87) PCT Pub. No.: WO2008/122706

PCT Pub. Date: Oct. 16, 2008

(65) Prior Publication Data

US 2010/0300935 A1 Dec. 2, 2010

(30) Foreign Application Priority Data

Mar. 2, 2007 (FR) ..... 07 01601

(51) Int. Cl.
*C10G 25/05* (2006.01)
*C10G 45/02* (2006.01)

(52) U.S. Cl. ..... 208/91; 208/211

(58) Field of Classification Search ..... 208/91, 208/211

See application file for complete search history.

(56) References Cited

U.S. PATENT DOCUMENTS

| | | | |
|---|---|---|---|
| 3,063,933 | A | 11/1962 | Meiners |
| 6,248,230 | B1 | 6/2001 | Min et al. |
| 2004/0118748 | A1 | 6/2004 | Lesemann et al. |

FOREIGN PATENT DOCUMENTS

| | | | |
|---|---|---|---|
| WO | WO 99/67345 | A | 12/1999 |
| WO | WO 2005/056728 | A | 6/2005 |

OTHER PUBLICATIONS

"International Search Report," International Application No. PCT/FR2008/000206, Date of publication Oct. 7, 2008, Date of mailing Oct. 16, 2008, 3 pages.

Technische Universiteit Delft, "A Unique Way to Make Ultra Low Sulfur Deisel," Min W., Korean Journal of Chemical Engineering, vol. 19, pp. 601-606, XP008084152, year 2002.

*Primary Examiner* — Randy Boyer

(74) *Attorney, Agent, or Firm* — Millen, White, Zelano & Branigan, P.C.

(57) ABSTRACT

The invention describes an improved process for deep desulfurization of a gas-oil-type hydrocarbon fraction that comprises a catalytic hydrodesulfurization unit that is preceded by a unit for adsorption of the nitrogen compounds that inhibit the hydrodesulfurization reaction.

7 Claims, 1 Drawing Sheet

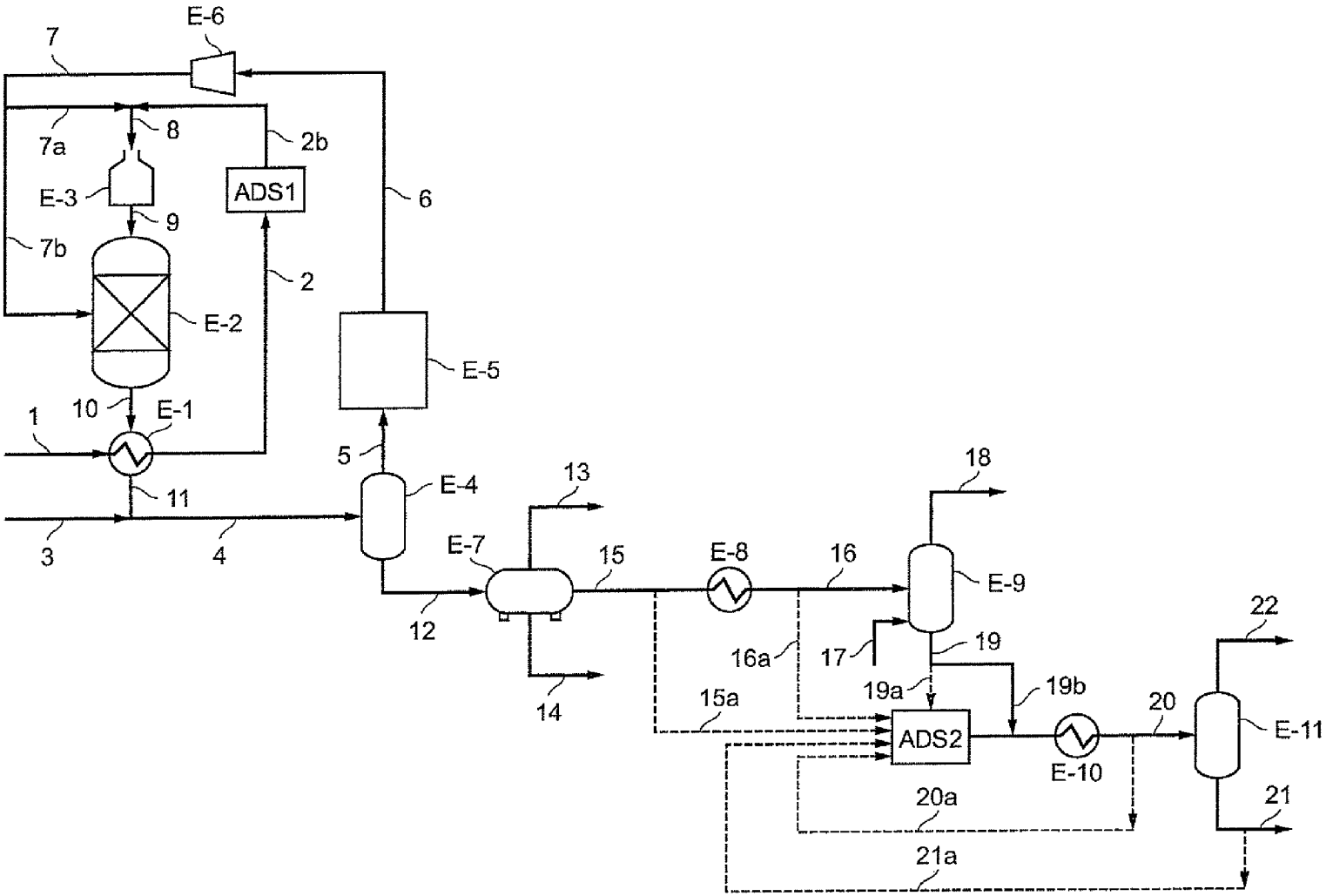
E-6
7
7a
7b
E-3
8
9
ADS1
2b
2
E-2
E-1
10
11
1
3
4
6
E-5
5
E-4
12
E-7
13
14
15
E-8
16
16a
15a
E-9
18
17
19
19a
ADS2
19b
E-10
20
20a
21a
E-11
22
21

PROCESS FOR DESULFURIZATION AND DENITRATION OF A GAS-OIL-TYPE HYDROCARBON FRACTION THAT CONTAINS NITROGEN COMPOUNDS

FIELD OF THE INVENTION

This invention relates to an improved process for deep desulfurization of a gas-oil-type hydrocarbon fraction that relies on a catalytic hydrodesulfurization unit (denoted HDS unit in abbreviated form in the text below) that is preceded by a unit for adsorption of inhibiting nitrogen compounds that are contained in the feedstock to be treated. The process essentially consists in using at least in part the desulfurized gas oil that is obtained following the HDS unit as a desorbent fluid to regenerate the adsorbent solid that is used in the unit for adsorption of the nitrogen compounds that are placed upstream from the HDS.

Such a process diagram makes it possible both to minimize the gas oil losses in the adsorption unit and to prevent the use of a desorbent fluid that is outside of the process that would then require the use of distillation towers for the purpose of the regeneration of said desorbent.

In addition, the elimination of the nitrogen compounds upstream from the HDS unit makes it possible to optimize the operating conditions of the latter, in particular to reduce the operating temperature within an interval that is generally between 200° C. and 400° C., and preferably between 250° C. and 350° C.

In the text below, a distillate-type fraction is defined as a fraction that is obtained from the distillation of crude or a conversion unit such as catalytic cracking, whose distillation interval is generally between 150° C. and 450° C. This fraction can be of any chemical nature, i.e., it can have any distribution between the different chemical families, in particular the paraffins, olefins, naphthenes, and aromatic compounds.

In the text below, we will conventionally call this fraction gas oil, but this designation does not have any restrictive nature. Any hydrocarbon fraction that contains sulfur and hydrodesulfurization-inhibiting nitrogen compounds, and a distillation interval that is similar to that of a gas oil fraction, can be involved by the process that is the object of this invention.

The process according to this invention therefore makes it possible to produce a hydrocarbon fraction both from which possible nitrogen compounds have been removed and which is desulfurized to contents that are less than or equal to 10 ppm of sulfur by limiting the hydrocarbon losses and by simplifying the management of desorbent flow that is necessary for the regeneration of the adsorption unit. Ppm of sulfur (or of nitrogen) is defined for the entire remainder of the text as ppm by weight related to the elementary sulfur (or to the elementary nitrogen), regardless of the organic molecule(s) in which the sulfur (or nitrogen) is engaged.

The specifications on the automobile fuels provide a great reduction of the sulfur content in the fuels, and in particular on the gas oils. This reduction is designed to limit the content of sulfur and nitrogen oxide in the exhaust gases of automobiles.

European legislation sets the sulfur content in gas oils at 50 ppm from 2005, a value that is to move to 10 ppm starting in 2009.

The tougher stance on the specification of sulfur content in the fuels therefore requires the enhancement of existing hydrotreatment catalytic processes with the nearly certain result of a more or less significant increased consumption of hydrogen.

Another approach that is complementary to the preceding approach consists in installing, upstream from the hydrotreatment unit, a unit for adsorption of various impurities that are contained in the feedstock, and in particular nitrogen compounds that are known for being inhibitors of hydrotreatment catalysts, whereby said adsorption unit comprises a more or less complex regeneration phase.

This invention can therefore be defined as an improved process for deep desulfurization of the gas oil fractions that can be applied to any feedstock that contains inhibiting nitrogen compounds with a content of between 100 and 2,000 pm of nitrogen.

The gain that is associated with an optimization of the operating conditions of the HDS is described in, for example, the article "A Unique Way to Make Ultra Low Sulfur Diesel," Korean Journal of Chemical Engineering, Vol. 19 (4) 2002, pp. 601-606, that it is possible to translate by "Une voie unique pour l'obtention de gazoles à très basse teneur en soufre" that appeared in the Korean Chemical Engineering Journal, Volume 19.

The problem that is posed by the addition of an adsorption unit upstream from the hydrotreatment unit is essentially connected to the regeneration of the adsorbent solid that is used in said adsorption unit.

Actually, whereby the adsorption capacities of nitrogen compounds are generally low due to their low concentration in the feedstock, and to a lesser extent due to the adsorption competition with the sulfur compounds and aromatic compounds, it is necessary to regenerate the adsorbent solid uniformly to ensure a reasonable service life. However, the regeneration is done generally either by the combustion of the adsorbed compounds or by using a solvent of, for example, aromatic nature, used to desorb the adsorbed molecules. The solvent generally is not obtained from the process itself, and it should therefore be separated from the gas oil that is contained in the pores of the adsorbent masses to allow its reuse in the adsorption process.

These regeneration operations involve, on the one hand, significant gas-oil losses, and, on the other hand, costs that in some cases can put a heavy strain on the economy of the process.

This invention essentially consists in using a portion of the flow of the desulfurized gas oil that is produced leaving hydrodesulfurization to ensure the regeneration of the adsorption unit that is located upstream from the HDS. A flow of gas oil sampled at one or more suitable points of the process according to the invention will make it possible to desorb the inhibiting nitrogen compounds and to recover the gas oil that is contained in the pores of the adsorbent masses. This operation is possible provided that the resulting mixture of the gas oil that is accumulated in the pores of the adsorbent solid and of the gas oil that is obtained by HDS has a sulfur content that is less than the required specification, without, however, imposing any specification that is too strict on the sulfur content of the gas oil that exits from the HDS unit. An example that is provided in the text below shows that in a wide range of sulfur content and nitrogen content of the gas-oil fraction that is to be treated, the process according to the invention is perfectly feasible.

EXAMINATION OF THE PRIOR ART

U.S. Pat. No. 6,248,230 B1 describes a method for the production of suitable fuels by withdrawing a portion of the natural polar compounds (NPC in abbreviated form) by adsorption on silica, for example before hydrotreatment. The desorbents that are used for the regeneration of the adsorbent are alcohol-type solvents that should be regenerated by distillation. This type of concatenation requires the use of distillation columns to regenerate the desorbent, which gives rise to a significant cost. In addition, the cited patent proposes withdrawing a set of polar compounds (alcohols, acids, nitrogen compounds and sulfur compounds), which has the effect of reducing the adsorption capacity of inhibiting nitrogen compounds. This invention only recommends the withdrawal of inhibiting compounds from hydrotreatment catalysts, and more particularly nitrogen compounds, with the highest possible adsorption selectivity toward said compounds.

U.S. Pat. No. 6,551,501 B1 describes a combined process for gas-oil hydrotreatment that relies on a unit for adsorption of inhibiting compounds using an acidic adsorbent solid that includes an FCC catalyst. The adsorbent solid is then regenerated either by stripping or by combustion. This invention is distinguished from the U.S. patent that is cited by the type of regeneration. Actually, the regeneration according to the invention is carried out using a liquid hydrocarbon that is part of the process itself, and that will be called internal to the process for this reason.

The patent US 2004,0118,748A1 describes a process for eliminating nitrogen or sulfur hydrocarbon compounds with 12 or more carbon atoms, a process using adsorption on a solid that contains a silica whose Lewis acidity is higher than or equal to 500 μmol/g. The unit μmol/g means $10^{-6}$ mol per gram. The regeneration of the solid is carried out using a solvent such as alcohol, aldehyde, ether or ketone.

The type of desorbent that is used in this invention is aromatic in nature and prevents the distillation of the latter.

The patent WO 2005056728 A2 describes a process for hydrotreatment of gas oil in two stages, including an intermediate stage for eliminating the nitrogen compounds in two catalytic hydrodesulfurization stages. The adsorption of the nitrogen compounds is preferably carried out by contact with nitric acid, whereas in this invention, the elimination of the nitrogen compounds is done by adsorption on adsorbent masses.

SUMMARY DESCRIPTION OF THE FIGURE

FIG. 1 shows a complete diagram of the deep hydrodesulfurization process according to this invention that makes it possible to specify the sampling points of the gas oil that is necessary to the desorption phase of the nitrogen compounds.

SUMMARY DESCRIPTION OF THE INVENTION

The invention can be defined as a process for deep desulfurization of a gas-oil-type hydrocarbon feedstock, with a distillation interval of between 150° C. and 450° C. and of any chemical nature.

The process according to the invention applies particularly to feedstocks that contain nitrogen compounds that are known for being inhibitors of hydrodesulfurization catalysts, and which for this reason should be eliminated upstream from said hydrodesulfurization unit.

The inhibiting nitrogen compound content of the feedstock to be treated is generally more than 50 ppmN by weight, and preferably more than 100 ppmN.

The process therefore consists in a first step of putting into contact the feedstock to be treated with a selective solid adsorbent for nitrogen compounds that inhibit the HDS reaction.

The contact is made in an adsorption unit that operates according to an adsorption-desorption cycle. The adsorption unit can operate either at ambient temperature or at the temperature that is obtained after a feedstock/effluent exchanger is placed upstream from the HDS reactor. The contact between the hydrocarbon feedstock and the adsorbent bed is made generally before the hydrogen is mixed with the hydrocarbon feedstock to be treated by HDS so as to allow an adsorption in liquid phase. The adsorbent bed moves into a regeneration phase when the inhibiting nitrogen compounds begin to be found again in the effluent, a phenomenon that is well known to one skilled in the art under the name of "piercing."

To allow a continuous operation, the adsorption-desorption unit will therefore comprise at least two beds that work alternately in an adsorption phase and in a regeneration phase.

This arrangement will make it possible for the gas oil that leaves the adsorption unit to be sent continuously to the HDS reactor with a reduced inhibiting nitrogen compound content.

The hydrotreated gas oil that is obtained by HDS is used in part to regenerate the adsorbent solid used in the adsorption unit that is saturated with inhibiting nitrogen compounds. The desorption of the adsorbent solid is done by contact of the saturated adsorption bed with a certain quantity of desulfurized liquid gas oil that is obtained following the gas/liquid separator(s) placed downstream from the HDS reactor, so as to ensure a regeneration of the adsorbent solid in the liquid phase.

During the regeneration, the desulfurized gas oil that is sampled at the HDS outlet to allow the desorption is in a mixture with the majority of the initial gas oil that is locked in the pores of the bed. Let's call the resulting gas oil the mixture of desulfurized gas oil that was used in the desorption and in the desorbed gas oil, initially contained in the pores of the adsorption bed, and which therefore contains both nitrogen and sulfur compounds.

This invention offers an industrial advantage only if the sulfur concentration of the resulting gas oil is less than the required sulfur specifications, without, however, imposing a specification that is too strict or that is impossible to achieve at the outlet of the HDS unit. Within the scope of this invention, the lower limit to the sulfur content of the gas oil at the outlet of the HDS unit has been set close to 1 ppmS and preferably close to 3 ppmS, which can be considered as a realistic condition.

Relative to the processes of the prior art, this invention offers the important advantage of avoiding any addition of desorbent that is outside of the process.

The process according to the invention also makes possible the recovery of almost all of the gas oil that is contained in the pores of the adsorption bed(s). It is in this sense that the invention can be defined as an improved process for desulfurization and denitrogenation of a gas-oil-type fraction.

The sulfur content of the resulting gas oil, in the meaning that was given above to this term, is generally less than 10 ppmS, with a yield by weight related to the upper feedstock at 97%, and preferably more than 99%.

The process according to this invention can therefore be defined as a process for deep desulfurization of a hydrocarbon fraction with a distillation interval of between 150° C. and 450° C. and that contains nitrogen compounds with a content of more than 50 ppmN by weight, preferably more than 100 ppmN. The process according to the invention comprises at least one adsorption unit of said nitrogen compounds that is followed by a hydrodesulfurization unit (HDS), whereby the unit for adsorption of the nitrogen compounds relies on the capture masses that are regenerated by desorption by means of a portion of the desulfurized gas oil effluent that is obtained from the hydrodesulfurization unit of said process.

Generally, the effluent gas oil of the hydrodesulfurization unit has a sulfur content of more than 3 ppmS.

Preferably, the adsorbent masses that are used in the adsorption unit of the nitrogen compounds are selected from among the faujasite-type zeolites that have an Si/Al ratio that is more than 1. The gas oil that is used for the regeneration of the adsorption unit is most often sampled from one or more points of the treatment chain downstream from the hydrodesulfurization unit, such that the temperature is between 140° C. and 180° C., and preferably between 150° C. and 170° C.

The water content in the gas oil that is used for the desorption phase is generally between 10 ppm and 5,000 ppm, and preferably between 100 ppm and 4,000 ppm. It is a matter here of ppm by weight relative to the water molecule. Preferably, the gas oil that is used for the regeneration of the adsorption unit is sampled at one or more points of the treatment chain downstream from the hydrodesulfurization unit such that the water content of the gas oil corresponds to the saturation value at the temperature of said sampling point(s).

DETAILED DESCRIPTION OF THE INVENTION

The process according to the invention comprises at least one unit for adsorption of nitrogen compounds that are contained in the gas oil feedstock that is to be treated, followed by a unit for hydrodesulfurization of the denitrated gas oil.

The adsorption unit generally comprises at least two reactors denoted ADS1, which operates alternately by adsorption, and then by regeneration (or desorption), and ADS2, which operates alternately by regeneration, and then by adsorption.

These two reactors are at a minimum necessary for allowing a continuous operation of the process. The ADS1 reactor operates in the adsorption mode, while the ADS2 reactor is in the regeneration mode. Once the cycle time $t_{cycle}$ has elapsed, the ADS1 reactor moves into the desorption phase, while the ADS2 reactor moves into the adsorption phase.

The gas oil that is to be treated and that has sulfur concentration $C_{feedstock}$ is sent into the adsorption unit ADS1/ADS2 for a cycle time $t_{cycle}$ and delivers a gas oil of reduced concentration in inhibiting nitrogen compounds of HDS.

The denitrated gas oil is then sent into the HDS unit, in which the sulfur content will be reduced from $C_{feedstock}$ to $C_{HDS}$ to form the desulfurized gas oil whose sulfur concentration is $C_{HDS}$.

The desulfurized and denitrated gas oil is then sent into the adsorption unit ADS1/ADS2 for regeneration, whereby gas oil that is charged with nitrogen compounds is contained in the pores of the adsorbent bed. The gas oil flow that is used for the regeneration of adsorbent masses then desorbs the nitrogen compounds and moves the quantity of gas oil contained in the pores of the adsorbent bed with a sulfur concentration $C_{feedstock}$ to obtain the desulfurized gas oil with a sulfur concentration of $C_{final}$.

The sulfur content of the gas oil that is obtained at the outlet of the HDS unit (denoted $C_{HDS}$) and before regeneration of the adsorption unit depends on a certain number of factors: the VVH (abbreviation of hourly volumetric flow rate) of the adsorption unit, the cycle time $t_{cycle}$ of the adsorption unit, the total porosity $\epsilon_T$ of the adsorbent solid, the sulfur concentration of the feedstock to be treated $C_{feedstock}$, and the sulfur concentration of the resulting gas oil $C_{final}$.

The VVH of the adsorption unit that is expressed in hour-1 is defined as the volumetric flow rate of feedstock that enters into the adsorption unit that is divided by the volume of adsorbent solid.

The cycle time $t_{cycle}$ that is expressed in hours is defined as the time during which the adsorption unit operates in the adsorption phase. The cycle time $t_{cycle}$ is generally selected at the highest value possible. Typically, within the scope of this invention, this cycle time is more than 10 hours and preferably more than 20 hours.

The total porosity of the adsorbent solid $\epsilon_T$ is defined as being the ratio between the volume of the entire empty space of the adsorption bed (intragranular porosity plus intergranular porosity) relative to the total volume that is occupied by the adsorbent solid.

The sulfur concentration of the final gas oil $C_{final}$ that is expressed in ppmS depends on the required sulfur specifications.

The sulfur concentration of the initial gas oil $C_{feedstock}$ expressed in ppmS depends on the feedstock to be treated.

The concentration leaving HDS, $C_{HDS}$, expressed in ppmS, then depends on the preceding parameters by the following equation that is obtained using a material balance that is written on the sulfur by making the hypothesis that the sulfur is not adsorbed on the adsorbent:

$$C_{HDS} = \left[\frac{VVH.t_{cycle}}{VVH.t_{cycle} - \varepsilon_T}\right].C_{final} - \left[\frac{\varepsilon_T}{VVH.t_{cycle} - \varepsilon_T}\right].C_{charge}\Big|_{[feedstock]}$$

Within the scope of the process according to the invention, $C_{HDS}$ is generally more than 1 ppmS, and preferably more than 3 ppmS.

The adsorbent solid that is used in the adsorption unit is selected for its capacity to retain the inhibiting nitrogen compounds of HDS in a selective manner relative to the other compounds of the feedstock that are the sulfur, aromatic, alkane and alkene compounds. The adsorbent solid can be selected from among the following families of solids: ion exchange resins, active carbons, silicas, aluminas, zeolites, metal oxides or reduced metals. It can also consist of a solid mixture that belongs to several of the above-mentioned families.

The solids can also be treated if necessary to make them more selective. For example, it is possible to deposit acids on the surface of alumina-type solids so as to promote the adsorption of basic nitrogen compounds that are optionally contained in the feedstock.

Preferably, an adsorbent solid that belongs to the family of zeolites is used, and even more preferably, the adsorbent solid consists of X or Y faujasite-type zeolites with an Si/Al ratio of more than 1.

The operating temperature of the adsorption unit is selected based on the nature of the nitrogen compounds to be treated, and the competition of adsorption with the other compounds of the feedstock, in particular the sulfur compounds of which it is desired to retain the least possible relative to the nitrogen compounds.

The operating temperature of the adsorption unit in the regeneration phase is based on the nature and the concentration of aromatic compounds that are obtained after HDS as well as the water content in the desulfurized gas oil following the stripping stage with steam that is generally used to eliminate the major portion of the water that is found mixed with the gas oil at the outlet of the HDS unit.

Actually, the gas oil that is obtained after HDS has a more or less strong desorbent power based on its concentration of aromatic compounds and water. The water content in the gas oil that is used for the desorption phase is between 10 and 5,000 ppm, and preferably between 100 and 4,000 ppm.

The temperatures in the adsorption phase and the regeneration phase should preferably remain less than the degradation temperature for the feedstock that is used, which is typically from 450° C. for a gas oil feedstock.

The pressure of the adsorption unit is selected in an interval that is between 2 bar and 20 bar and preferably between 5 bar and 15 bar (1 bar=$10^5$ Pascal).

The quantity of adsorbent solid to be used depends on the VVH (hourly volumetric flow rate) that is defined as a ratio between the liquid volumetric flow rate of the feedstock relative to the volume to the adsorbent solid that is used. The VVH is between 0.1 $h^{-1}$ and 10 $h^{-1}$, and preferably between 0.5 $h^{-1}$ and 5 $h^{-1}$.

The operating conditions of the hydrodesulfurization unit are well known to one skilled in the art.

The gas-oil-type hydrocarbon feedstock is sent into the HDS reactor at a temperature that is generally between 200° C. and 450° C., and in the presence of hydrogen.

The catalysts that are used for the HDS reaction in general consist of nickel sulfides, or cobalt sulfides, or molybdenum sulfides, or tungsten sulfides, by themselves or in a mixture. These sulfides are in general deposited on a substrate that consists of silica, alumina, silica-alumina, or zeolites (crystallized alumino-silicate).

The hourly volumetric flow rate (VVH) of the HDS unit is generally between 0.1 and 10 m3/m3/h.

The reaction temperature depends both on the nature of the feedstock and the desired severity, but it is generally between 200° C. and 400° C., and preferably between 250° C. and 350° C.

The hydrogen pressure of the unit is generally between 6 bar and 70 bar and preferably between 10 bar and 40 bar. The hydrogen to hydrocarbon ratio that is expressed in terms of m3/m3 (or a non-dimensional number) is generally between 70 m3/m3 and 300 m3/m3, and preferably between 100 and 250 m3/m3.

FIG. 1 corresponds to a detailed diagram of the process for desulfurization and denitrogenation according to this invention.

This FIGURE makes it possible to better understand the possible sampling points of the desulfurized gas oil that is used for the regeneration phase of the adsorption unit.

In the diagram of FIG. 1, the block denoted ADS1 represents the adsorption unit in the adsorption phase, and the block ADS2 represents the adsorption unit in the desorption phase. The flow (1) represents the gas oil feedstock that is to be desulfurized. Let us recall that the operating time of the adsorption unit in the adsorption phase (or in the desorption phase) is the cycle time. The flow (1) is sent into a feedstock/effluent exchange E-1 to reach a temperature level of about 260° C. The flow (2) that is thus obtained is sent into the adsorption unit ADS1. The adsorption unit ADS1 is preferably located downstream from the exchanger E-1 so as to limit the competitive adsorption of sulfur compounds.

The flow (2*b*) that is obtained at the outlet of the adsorption unit ADS1 is mixed with the hydrogen flow (7*a*) to obtain the flow (8) of denitrogenated gas oil. This flow (8) is sent into an oven or any other preheating system, denoted E-3, to bring the temperature at the inlet of the HDS unit to the required value, or between 200° C. and 400° C., based on the sulfur content of the feedstock to be treated, the VVH that is selected, and the catalyst that is used.

The preheated flow (9) is sent into the HDS reactor (denoted E-2), which can contain an intermediate stage of hydrogen addition (7*b*).

The effluent flow (10) from the HDS unit is cooled by the feedstock/effluent exchanger E-1 for producing the flow (11). The flow (11) is mixed with the make-up hydrogen flow (3) that is used to replace the hydrogen that is consumed in the HDS reactor. The mixture of the flows (11) and (3) constitutes the flow (4).

The flow (4) is sent into a gas/liquid separator tank E-4 that makes it possible to obtain, on the one hand, a gaseous flow (5) of hydrogen and hydrogen sulfide, and, on the other hand, a liquid flow (12) of desulfurized gas oil and light hydrocarbons.

The flow (5) is sent into a treatment block E-5 for eliminating the H2S. At the outlet of the treatment block E-5, a flow (6) of clean hydrogen is obtained that is compressed in the unit E-6 to obtain the hydrogen flow (7) that is used to supply the HDS reactor (E-2) with two sub-flows (7*a*) and (7*b*).

The flow (12) is sent into a separator tank E-7 for eliminating the light compounds (13) and other compounds such as water (14).

The flow (15) of desulfurized gas oil without water can be used in part (flow 15*a*) to regenerate the adsorption unit ADS1 at a temperature that is close to 50° C.

The flow (15) is reheated in the exchanger E-8 to obtain the flow (16) at a temperature that is close to 180° C. This flow (16) can also be used in part (flow 16*a*) to regenerate the adsorption unit ADS1.

The flow (16) is sent to a steam stripper E-9 that is supplied by a water flow (17).

The light compounds that correspond to the flow (18) are evacuated, and the flow (19) at about 160° C. can also be used in part to regenerate the adsorption unit ADS1. Preferably, this flow (19) is used at least in part (flow 19*a*) as a regeneration fluid in the adsorption unit ADS2, because the water that is contained in said flow (19) makes it possible to assist in the desorption of the inhibiting nitrogen compounds.

The flow (19*b*) is cooled in an exchanger E-10 to obtain the flow (20) that corresponds to a gas oil at 80° C. This flow (20) can also be used in part (flow 20*a*) to regenerate the adsorption unit ADS1.

The flow (20) is sent into a separator tank E-11 that makes it possible to separate the water (22) and the desulfurized gas oil that corresponds to the flow (21) that can also be used in part (flow 21*a*) to regenerate the adsorption unit ADS1 at a temperature that is close to 90° C.

EXAMPLE ACCORDING TO THE INVENTION

The following example is designed by a laboratory experiment to verify the feasibility of the process according to the invention.

A direct distillation gas oil that contains 100 ppmN of nitrogen compounds is therefore represented by means of a model feedstock that consists of 100 ppmN of acridine representing nitrogen compounds and toluene to represent the rest of the compounds of the mixture. In a first stage, an adsorption column is filled that consists of 20 ml of an NaX-type faujasite of the Si/Al ratio of 1.42.

The adsorption column NaX is activated with nitrogen so as to eliminate the residual water.

The model feedstock is then run at a temperature of 100° C. with a VVH of 1 $hour^{-1}$ corresponding to a flow rate of 20 ml/hour. The adsorption isotherm of the acridine in the toluene on the NaX at this temperature corresponds to an adsorption capacity of 0.004 mol of acridine per gram of solid.

The adsorbent solid then retains the acridine for close to 500 hours before the content of nitrogen compounds can be detected.

In a second stage, sulfur compounds at a level of 5,000 ppmS are added to the model feedstock, sulfur compounds that will be eliminated by means of an HDS unit that in this experiment is shown by a small reactor in a stationary bed that contains a CoMo-type catalyst that consists of cobalt and molybdenum that are deposited on alumina and marketed by AXENS under the reference HR 306C.

The feedstock is mixed with hydrogen before the inlet of the reactor. This reactor is heated to 320° C. under a hydrogen pressure of 25 bar with a hydrogen to hydrocarbon ratio of 230 ml/ml.

The hydrogenation reactions, and more particularly the hydrodesulfurization reactions, make it possible to transform the sulfur that is contained in the organic molecules into hydrogen sulfide. At the outlet of the HDS reactor, a gas/liquid separator separates the gas effluents from the liquid effluents of the reactor.

The gas effluents consist primarily of hydrogen that is not consumed by the different reactions, light alkanes, i.e., saturated hydrocarbons (paraffins), whose number of carbon atoms is between 1 and 5 (from methane to pentane) and which also consist of H2S. These gas effluents are then treated by washing and by a stabilization column. These different stages, well known to one skilled in the art, will not be presented in more detail here.

At the outlet of the gas/liquid separator, the liquid consists of desulfurized gas oil, but it contains a little solubilized H2S. This gas oil is then sent into a nitrogen stripping column that makes it possible to eliminate several molecules of solubilized H2S in the liquid effluent. This desulfurized liquid effluent is then sent into a storage tank. This desulfurized feedstock is used to regenerate the sieve that is used in the adsorption stage.

A target concentration $C_{final}$ is set to reach 8 ppmS on the resulting gas oil.

The adsorbent bed has a total porosity of 0.5. By applying the formula that is provided in the description, or $$C_{HDS} = \left[\frac{VVH.t_{cycle}}{VVH.t_{cycle} - \varepsilon_T}\right].C_{final} - \left[\frac{\varepsilon_T}{VVH.t_{cycle} - \varepsilon_T}\right].C_{charge}\Big|_{[\text{Feedstock}]}$$

a value of the sulfur concentration at the outlet of the HDS unit equal to 3.6 ppmS is obtained, which conforms perfectly to the limits that we have set and validates the feasibility of the process according to the invention.

The invention claimed is:

1. A process for deep desulfurization of a hydrocarbon fraction with a distillation interval of between 150° C. and 450° C. and that contains nitrogen compounds with a content of more than 50 ppmN by weight, wherein said process comprises at least one adsorption unit for said nitrogen compounds followed by a hydrodesulfurization unit (HDS), wherein the adsorption unit for the nitrogen compounds comprises at last one capture mass selected among faujasite-type zeolites having an Si/Al ratio more than 1, which are regenerated by desorption with at least one part of desulfurized gas oil effluent obtained from the hydrodesulfurization unit, wherein the gas oil employed for the regeneration of the captive mass is sampled at a point of downstream from the hydrodesulfurization unit such that the temperature of the gas oil is between 140° C. and 180° C., and such that the water content of the gas oil corresponds to the saturation value at the temperature of the sampling point.

2. A process for deep desulfurization of a gas-oil-type hydrocarbon fraction according to claim 1, wherein cycle time, defined as the time during the adsorption unit operates by adsorption, is more than 10 hours.

3. A process for deep desulfurization of a gas oil fraction according to claim 1, wherein feedstock to be treated (1) is sent into a feedstock/effluent exchanger (E-1) to be heated to a temperature level of about 260° C., and resultant heated feedstock (3) is sent into the adsorption unit (ADS1) located downstream from the exchanger (E-1); resultant flow (2*b*) that is obtained at the outlet of the adsorption unit (ADS1) is mixed with a hydrogen flow (7*a*) to obtain the denitrogenated gas oil flow (8), which is sent into a preheating system (E-3), to bring the temperature at the inlet of the HDS unit to a value of between 200° C. and 400° C.; the resultant preheated gas oil flow (9) is sent into HDS reactor (E-2) whose effluent (10) is cooled by a feedstock/effluent exchanger (E-1) to produce flow (11); said flow (11) is mixed with a make-up hydrogen flow (3) to constitute a flow (4); said flow (4) is sent into a gas/liquid separator tank (E-4) to obtain, on the one hand, a gas flow (5) of hydrogen and hydrogen sulfide, and, on the other hand, a liquid flow (12) of desulfurized gas oil and light hydrocarbons; said liquid flow (12) is sent into a separator tank (E-7) to eliminate light compounds (13) and other compounds including water (14); and the resultant desulfurized gas oil flow (15) depleted in water is used in part (flow 15*a*) to regenerate an adsorption unit (ADS2) at a temperature close to 50° C.

4. A process for deep desulfurization of a gas oil fraction according to claim 3, wherein the desulfurized gas oil flow (15) is reheated in exchanger (E-8) to obtain flow (16) at a temperature close to 180° C., whereby the flow (16) used in part (flow 16*a*) regenerates the adsorption unit (ADS2).

5. A process for deep desulfurization of a gas oil fraction according to claim 3, wherein the flow (16) is sent into a steam stripper (E-9) that is supplied by a water flow (17) from which a flow (19) is extracted at about 160° C. that is used in part to regenerate the adsorption unit (ADS2).

6. A process for deep desulfurization of a gas oil fraction according to claim 3, wherein a flow (19*b*) is split off from flow (19) and is cooled in an exchanger (E-10) to obtain a flow (20) that corresponds to a gas oil at 80° C. that is used in part (flow 20*a*) to regenerate the adsorption unit (ADS2).

7. A process for deep desulfurization of a gas oil fraction according to claim 6, wherein the flow (20) is sent into a separator tank (E-11) to separate water (22) and desulfurized gas oil that corresponds to flow (21) that is used in part (flow 21*a*) to regenerate the adsorption unit (ADS2) at a temperature that is close to 90° C.

* * * * *